United States Patent [19]

Komiyama et al.

[11] 4,291,400

[45] Sep. 22, 1981

[54] ELECTRONIC TIMEPIECE

[75] Inventors: Katsuhiko Komiyama; Toshio Hiruta, both of Tokyo, Japan

[73] Assignee: Citizen Watch Co. Ltd., Tokyo, Japan

[21] Appl. No.: 6,364

[22] Filed: Jan. 25, 1979

Related U.S. Application Data

[63] Continuation of Ser. No. 831,509, Sep. 8, 1977, abandoned.

[30] Foreign Application Priority Data

Sep. 14, 1976 [JP] Japan ..... 51-119494

[51] Int. Cl.[3] ..... G04C 19/00; G04C 23/02

[52] U.S. Cl. ..... 368/84; 368/88

[58] Field of Search ..... 368/84, 88, 239, 242, 368/203, 204, 276, 308, 319-321

[56] References Cited

U.S. PATENT DOCUMENTS

| | | | |
|---|---|---|---|
| 3,846,971 | 11/1974 | Ho et al. | 368/88 |
| 3,991,554 | 11/1976 | Somogyi | 368/224 |
| 4,019,313 | 4/1977 | Mason et al. | 368/204 |
| 4,020,627 | 5/1977 | Yoshida et al. | 368/204 X |
| 4,068,464 | 1/1978 | Barnett et al. | 368/204 |

*Primary Examiner*—Vit W. Miska

*Attorney, Agent, or Firm*—Sherman & Shalloway

[57] ABSTRACT

An electronic timepiece comprising a module composed of four constitutional elements, i.e. a liquid crystal cell, a liquid crystal cell position determining member, a circuit substrate and a protective cover is disclosed. To the protective cover are secured switch parts each having one end connected to a contact on the circuit substrate and the other end connected to an electrically conductive portion of a push button.

11 Claims, 9 Drawing Figures

ELECTRONIC TIMEPIECE

This is a continuation of application Ser. No. 831,509, filed Sept. 8, 1977, now abandoned.

BACKGROUND OF THE INVENTION

This invention relates to an electronic timepiece comprising a module composed of four constitutional elements, i.e. a liquid crystal cell, a liquid crystal cell position determining member for enclosing the liquid crystal cell therein, a circuit substrate arranged beneath the member and a protective cover arranged beneath the circuit substrate.

In an electronic timepiece for displaying a time, etc. by means of a liquid crystal, photodiode, etc., that is, in a so-called digital type electronic timepiece, switching operations for correcting and changing over displays, etc. are complex and troublesome so that in practice it is difficult to effect such switching operations by means of only one switch part such as a winding stem, etc. But, provision of a number of switch parts not only makes the timepiece complex in construction and arrangement but also makes the switch parts troublesome in assembling. In addition, almost all of the switch parts are composed of push buttons, so that the push button must be constructed such that it is stopped at a given position when it is pushed for the purpose of ascertaining whether or not the switch part is operated in a moderate manner. In addition, when a circuit substrate is formed of ceramics, etc. which are brittle due to unfirm bonding structure of metal and ceramics, a force must not be subjected thereto when the switch part as a movable part is operated.

SUMMARY OF THE INVENTION

An object of the invention, therefore, is to provide an electronic timepiece comprising a module constructed and arranged such that the above mentioned drawbacks are eliminated, that switch parts are easy in assembling and reliable in operation, and that a circuit substrate formed of ceramics is prevented from being broken by operating the switch parts.

The invention will now be described in greater detail with reference to the accompanying drawings.

DESCRIPTION OF THE PREFERRED EMBODIMENTS OF THE INVENTION

Figure 1:
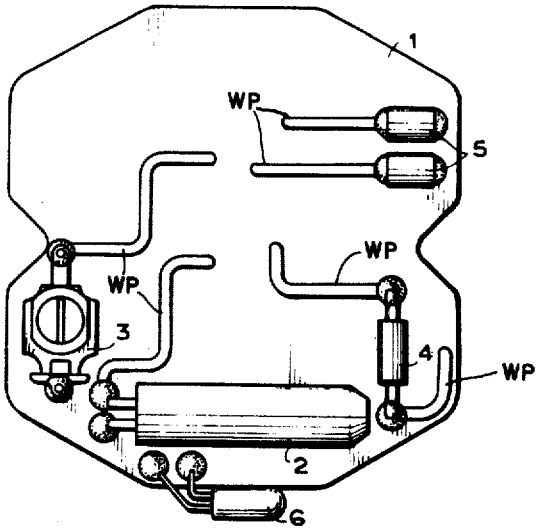
FIG. 1 is a plan view of a circuit substrate of an electronic timepiece according to the invention.

In FIG. 1 is shown a circuit substrate 1 formed of ceramics. Reference numeral 2 designates a crystal oscillator; 3 a trimmer condenser; 4 a temperature compensation condenser; 5 a voltage step-up condenser; and 6 an illumination lamp. These circuit elements 2 to 6 are secured by soldering to the circuit substrate 1 and are made electrically conductive to a wiring pattern WP printed on the circuit substrate 1. The circuit substrate 1 is provided at its reverse surface with circuit chips (not shown).

Figure 2A:
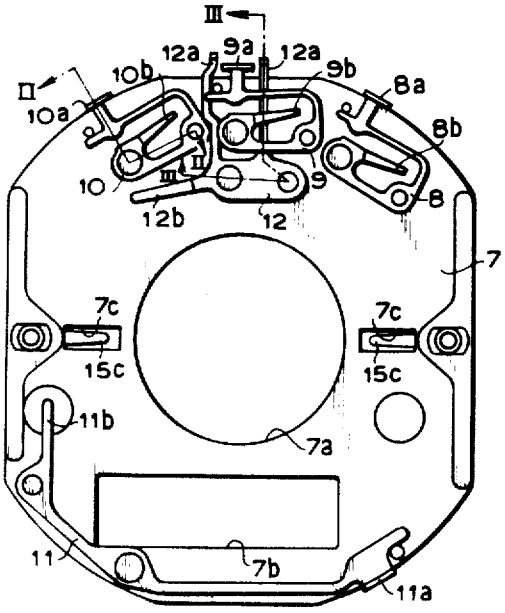
FIG. 2A is a plan view of a protective cover of an electronic timepiece according to the invention.

In FIG. 2A is shown a protective cover 7 formed of an insulating plastic, etc. Reference numeral 8 designates a display change-over switch part; 9 a correction switch part; 10 a lamp switch part and 11 a return-to-zero switch part. These switch parts 8 to 11 are formed of springs and engage with dowels projected upwardly from the protective cover 7 and are secured thereto by deforming the upper ends of these dowels by heating under pressure.

Figure 2B:
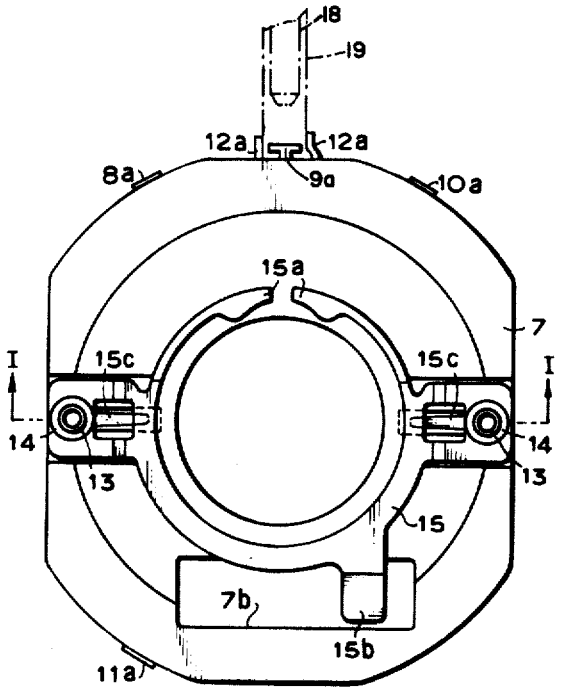
FIG. 2B is a plan view of a reverse side of the protective cover shown in FIG. 2A.
Figure 2C:
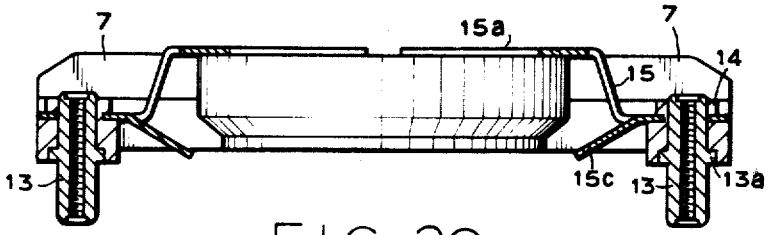
FIG. 2C is a section on line I—I of FIG. 2B.
Figure 2D:
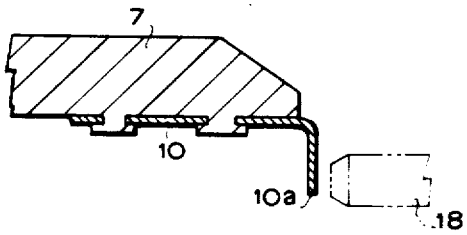
FIG. 2D is a section on line II—II of FIG. 2A.

As shown in FIG. 2D which is a section on line II—II of FIG. 2A, front ends 8*a*, 9*a*, 10*a* and 11*a* of the switch parts 8 to 11 are made contact with a push button 18 provided at a side portion of a timepiece case when the push button 18 is pushed, respectively. The other ends 8*b*, 9*b*, 10*b* and 11*b* of the switch parts 8 to 11 are directly connected to contacts on the wiring pattern of the circuit substrate 1 when the circuit substrate 1 is assembled together with a liquid crystal cell position determining member 16 to be described later with reference to FIG. 3.

Figure 2E:
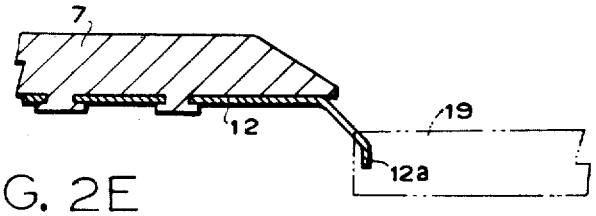
FIG. 2E is a section on line III—III of FIG. 2A.

Reference numeral 12 designates a connection part which functions to electrically connect the circuit substrate 1 to the push button 18. The connection part 12 is formed of a spring and provided at its front end with bifurcated portions 12*a*, 12*a* adapted to be engaged with both side surfaces of an electrically conductive pipe 19 as shown in FIG. 2E which is a section on line III—III of FIG. 2A, the pipe 19 being connected to the push button 18. As a result, the connection part 12 functions to connect the circuit substrate 1 through the pipe 19 to the push button 18. The other end 12*b* of the connection part 12 is connected to the contacts on the wiring pattern of the circuit substrate 1 in the similar manner as those of the other switch parts 8 to 11.

The protective cover 7 for covering the circuit substrate 1 is provided at its center with an opening 7*a* for enclosing an electric battery (not shown) therein and is provided at its periphery with an opening 7*b* for enclosing the crystal oscillator 2 therein. In addition, the protective cover 7 functions to cover the other circuit elements, i.e., the trimmer condenser 3, temperature compensation condenser 4 and voltage step-up condenser 5.

As shown in FIGS. 2B and 2C which is a section on line I—I of FIG. 2B, the protective cover 7 is provided at its diametrically opposite portions with tubes 13,13, each having an enlarged diameter portion 13*a*. Each tube 13 is secured to the protective cover 7 by means of the enlarged diameter portion 13*a* and a seat 14.

Reference numeral 15 designates a holder composed of an annular spring provided at its periphery with split forming ends 15*a*, 15*a*, a projection 15*b* and two diametrically opposed projections 15*c*,15*c*. The split forming ends 15*a*,15*a* serve to hold the electric battery therebetween and the projection 15*b* is urged against the crystal oscillator 2 so as to hold it. The projections 15*c*,15*c* are extended through the center hole 7*a* of the protective cover 7 and connected to the contacts on the wiring pattern of the circuit substrate 1.

Figure 3:
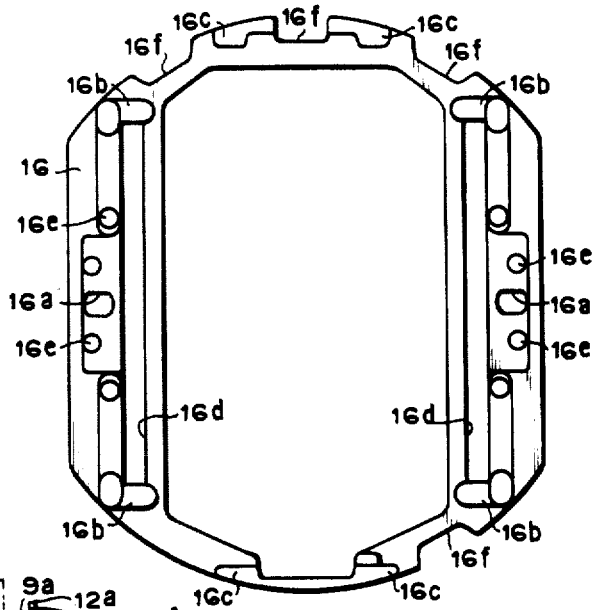
FIG. 3 is a plan view of a liquid crystal cell position determining member of an electronic timepiece according to the invention.

In FIG. 3 is shown a support frame which is a liquid crystal cell position determining member 16 provided at its side portion with holes 16*a*,16*a*. The tubes 13,13 of the protective cover 7 are extended through these holes 16*a*,16*a* and upper and lower ends of the tubes 13,13 are threadedly engaged with screws so as to sandwich the circuit substrate 1 between the protective cover 7 and the liquid crystal cell position determining member 16 as shown in FIG. 4B.

The liquid crystal position determining member 16 is provided at its end portions with opposed projection 16*b*, 16*b*; 16*c*,16*c* for determining position of display constitutional parts such as a liquid crystal cell polarizing plate, reflecting plate, light guide plate, etc. (not shown), provided at its side portions with two grooves 16*d*,16*d* through which are inserted electrically conductive rubber connectors for connecting the wiring pattern from the circuit chips to an outer electrode of the liquid crystal cell and provided at its side portion with four dowels 16*e*,16*e*,16*e*,16*e* for determining position of the liquid crystal cell 17. All of these portions of the liquid crystal cell position determining member 16 function to enclose the liquid crystal cell 17 therein.

In addition, the liquid crystal cell position determining member 16 is also provided at its end portions with four stopper portions 16*f*,16*f*,16*f*,16*f* each formed of a notch. Each of these four stopper portions is located at that portion of the liquid crystal cell position determining member 16 which corresponds to each of the switch parts 8 to 11.

Figure 4A:
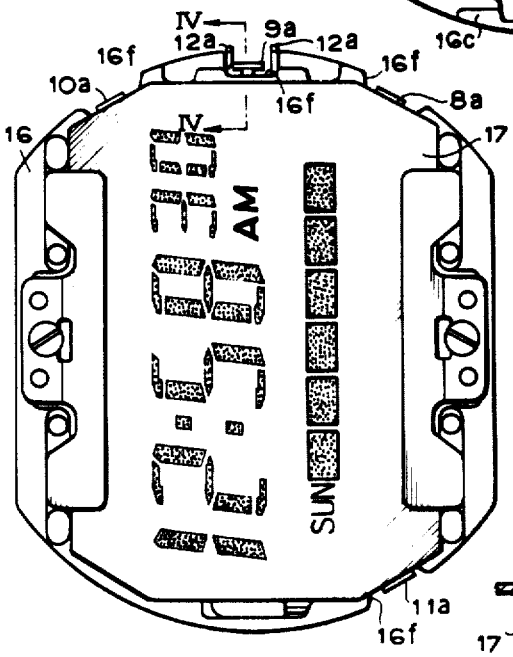
FIG. 4A is a plan view of a module of an electronic timepiece according to the invention.
Figure 4B:
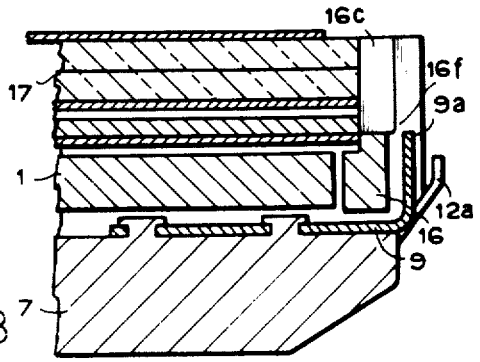
FIG. 4B is a section on line IV—IV of FIG. 4A.

In FIG. 4A is shown the liquid crystal cell 17 assembled together with the circuit substrate sandwiched between the protective cover 7 and the liquid crystal cell position determining member 16. As shown in FIG. 4B which is a section on line IV—IV of FIG. 4A, each of the front ends 8*a* to 11*a* of the switch parts 8 to 11 is opposed to each of the stopper portions 16*f* of the liquid crystal cell position determining member 16. That is, the front end 9*a* of the switch part 9 is urged by the push button 18 against the stopper portion 16*f* of the liquid crystal cell position determining member 16.

As a result, a user can easily feel a moderate mode of operation of the switch parts, whereby he is informed that the switch operation has been completed. In addition, the exterior force for operating the switch part is subjected to the liquid crystal cell position determining member 16 which is mechanically stronger than the other timepiece parts, so that there is no risk of the other timepiece parts being broken.

As stated hereinbefore, in the electronic timepiece according to the invention, all of the switch parts are secured to the protective cover, so that the switch parts are simple in construction and can easily be assembled together with any other timepiece parts. In addition, since the exterior force for operating the switch parts in subjected to the mechanically strong timepiece part composed of the liquid crystal cell position determining member, there is no risk of the other timepiece parts being broken. Moreover, the switch parts become stopped at a given position, so that the user can feel the moderate mode of switching operation whereby he can correctly operate the switch parts.

In addition, in accordance with the invention, provision is made of a bifurcated connection part 12 formed also of a spring and connected to an electrically conductive pipe 19 connected to the push button 18. As a result, if the connection part 12 is applied with a switch operating voltage, it is possible to operate the switch parts through the connection part 12, pipe 19 and push button 18. Such construction and arrangement of the switch and connection parts are significantly useful for a reverse cover formed of a non-electric conductive material if compared with the prior art electronic timepiece in which the switch operating voltage is supplied through the reverse cover.

What is claimed is:

1. A liquid crystal display timepiece module including electronic components comprising:

(a) a liquid crystal display cell;

(b) a support frame made of insulating plastic and supporting said liquid crystal display cell;

(c) a protective cover of insulating plastic adjacent to said support frame;

(d) a circuit substrate disposed between said liquid crystal display cell and said protective cover, said circuit substrate including a wiring pattern mounted on one surface thereof and connected to said electronic components;

(e) a plurality of electrode terminals formed on the under surface of said circuit substrate and electrically connected to said wiring pattern;

(f) a plurality of contact switches operable by an external control member being fixed on one surface of said protective cover between said protective cover and said circuit substrate, each of said contact switches including a terminal portion ending at an outer periphery of said protective cover;

(g) a resilient contact formed to each of said contact switches, said resilient contact mounted on said protective cover in electrical contact with said electrode terminals; and (h) joining means for joining said liquid crystal display cell, said support frame, said circuit substrate and said protective cover to form the module.

2. A liquid crystal display timepiece module including electronic components comprising:

(a) a liquid crystal display cell;

(b) a support frame made of insulating plastic and supporting said liquid crystal display cell;

(c) a protective cover of insulating plastic adjacent to said support frame;

(d) a circuit substrate disposed between said liquid crystal display cell and said protective cover, said circuit substrate including a wiring pattern mounted on one surface thereof and connected to said electronic components;

(e) a plurality of electrode terminals formed on the under surface of said circuit substrate and electrically connected to said wiring pattern;

(f) a plurality of contact switches operable by an external control member being fixed on one surface of said protective cover between said protective cover and said circuit substrate, each of said contact switches including a terminal portion ending at an outer periphery of said protective cover;

(g) a resilient contact formed to each of said contact switches, said resilient contact mounted on said protective cover in electrical contact with said electrode terminals;

(h) joining means for joining said liquid crystal display cell, said support frame, said circuit substrate and said protective cover to form the module; and (i) wherein said circuit substrate is formed of ceramics.

3. The liquid crystal display timepiece module according to claim 2 wherein said contact switches are composed of metal sheets.

4. The liquid crystal display timepiece module according to claim 3 wherein connecting means for electrically connecting said wiring pattern to at least one external control member is provided for generating a signal by selectively electrically connecting said external control member to said terminal portion ending at an outer periphery of said protective cover.

5. The liquid crystal display timepiece module according to claim 4 wherein said support frame includes a stopper portion adjacent each of said switch contacts for limiting said terminal portion movement.

6. The liquid crystal display timepiece module according to claim 5 wherein said connecting means is a bifurcated connection part formed about said terminal portion for connection to an electrically conductive pipe having a push button for selective connection to said terminal portion whereby depression of said push button completes a circuit of said wiring pattern.

7. The liquid crystal display timepiece module according to claim 6 wherein said protective cover has a plurality of protrusions, each of said contact switches has a rigid elongated portion having a hole though which at least one of the protrusions of said protective cover project, an end of said elongated portion having a resilient contact extending upwardly from said protective cover to contact said electrode terminals, the other end of said elongated portion having a slender resilient portion in the same plane as said elongated portion, the end of said slender resilient portion having a rigid hook portion and a rigid wide portion bent at a right angle to said plane on the outside periphery of said protective cover, said wide bent portion being applied to said external control member.

8. The liquid crystal display timepiece module according to claim 7 wherein said protective cover further includes a stopper for limiting movement of said rigid portion, thereby preloading said wide portion by holding said slender resilient portion in a bent position.

9. The liquid crystal display timepiece module according to claim 8 wherein said protective cover is made of a thermoplastic resin and has columns integral with said cover standing through said holes of said switches, the tops of said columns being heat-treated so that said switches are affixed to said protecting cover.

10. A liquid crystal display timepiece module including electronic components comprising:

(a) a liquid crystal display cell;

(b) a support frame made of insulating plastic and supporting said liquid crystal display cell;

(c) a protective cover of insulating plastic adjacent to said support frame;

(d) a circuit substrate disposed between said liquid crystal display cell and said protective cover, said circuit substrate including a wiring pattern mounted on one surface thereof and connected to said electronic components;

(e) a plurality of electrode terminals formed on the under surface of said circuit substrate and electrically connected to said wiring pattern;

(f) a plurality of contact switches operable by an external control member being fixed on one surface of said protective cover between said protective cover and said circuit substrate, each of said contact switches including a terminal portion ending at an outer periphery of said protective cover;

(g) a resilient contact formed to each of said contact switches, said resilient contact mounted on said protective cover in electrical contact with said electrode terminals;

(h) joining means for joining said liquid crystal display cell, said support frame, said circuit substrate and said protective cover to form the module; and (i) wherein all of said contact switches are fixed to said protective cover.

11. The liquid crystal display timepiece module according to claim 10 wherein all of said electronic components mounted on said protective cover have a resilient contact for resiliently contacting said electrode terminals.

* * * * *